US009138077B2

(12) United States Patent
Found

(10) Patent No.: US 9,138,077 B2
(45) Date of Patent: Sep. 22, 2015

(54) MODULAR HANGING STORAGE TRACKS

(71) Applicant: William Dane Found, Riverside, CA (US)

(72) Inventor: William Dane Found, Riverside, CA (US)

(73) Assignee: Hyperlilly, LLC, Riverside, CA (US)

( * ) Notice: Subject to any disclaimer, the term of this patent is extended or adjusted under 35 U.S.C. 154(b) by 184 days.

(21) Appl. No.: 13/754,731

(22) Filed: Jan. 30, 2013

(65) Prior Publication Data

US 2013/0199016 A1 Aug. 8, 2013

Related U.S. Application Data

(60) Provisional application No. 61/592,450, filed on Jan. 30, 2012.

(51) Int. Cl.

| | |
|---|---|
| ***A47F 5/08*** | (2006.01) |
| ***A47B 88/04*** | (2006.01) |
| *A47F 5/00* | (2006.01) |

(52) U.S. Cl.

CPC . *A47F 5/08* (2013.01); *A47B 88/04* (2013.01); *A47B 88/0407* (2013.01); *A47F 5/0025* (2013.01); *Y10T 29/49826* (2015.01); *Y10T 29/49879* (2015.01)

(58) Field of Classification Search

CPC ..... A47F 5/08; A47F 5/0025; A47B 88/0407; A47B 88/04; Y10T 29/49879; Y10T 29/49826

USPC ..... 29/428, 455.1; 312/245, 246, 298, 301, 312/350; 211/113, 85.29; 248/317

See application file for complete search history.

(56) References Cited

U.S. PATENT DOCUMENTS

| | | | | |
|---|---|---|---|---|
| 4,446,660 | A | 5/1984 | Miller et al. | |
| 4,653,818 | A * | 3/1987 | DeBruyn | 312/246 |
| 5,239,790 | A | 8/1993 | Fetzer | |
| 5,242,219 | A | 9/1993 | Tomaka | |
| 5,628,153 | A | 5/1997 | Fontanez | |
| 5,649,751 | A | 7/1997 | Longhurst | |
| 5,772,295 | A | 6/1998 | Sundmark | |
| 7,591,105 | B2 | 9/2009 | Balser | |
| 7,597,203 | B2 | 10/2009 | Jasniy | |
| 7,992,728 | B2 | 8/2011 | Burgess et al. | |
| 8,015,761 | B2 | 9/2011 | Wainland | |
| 2008/0036341 | A1 * | 2/2008 | Nilsen et al. | 312/246 |

* cited by examiner

*Primary Examiner* — John C Hong

(74) *Attorney, Agent, or Firm* — Knobbe Martens Olson & Bear LLP

(57) ABSTRACT

A hanger track system that can be mounted to horizontal or vertical surfaces including ceilings, joists, and walls. The hanger tracks include a surface on which a storage container may be supported. The hanger tracks are positioned substantially parallel to each other and spaced a distance apart such that a storage container can fit in between the hanger tracks and be supported by a portion of the tracks.

15 Claims, 17 Drawing Sheets

100
102
114
114
114
114

100
102
114
114
114
114
109
117
104

100
102
106
109
117
105a
104

MODULAR HANGING STORAGE TRACKS

CROSS-REFERENCE TO RELATED APPLICATIONS

This application claims priority under 35 U.S.C. §119 to U.S. Provisional Patent Application Ser. No. 61/592,450 filed Jan. 30, 2012, titled, "A plastic track designed to hang storage containers from their flange," which is incorporated by reference herein in its entirety. If any term in the referenced application is used differently than the instant application, the usage in the instant application shall control.

BACKGROUND OF THE INVENTION

1. Field of the Invention

The invention generally relates to mountable supports used to support storage containers.

2. Description of the Related Art

Many people use plastic containers to store items when the items are not in use. Storage containers may contain holiday decorations, winter clothes, sports equipment, or other items that are not used on a daily basis. Storage containers are often stacked on top of each other making it difficult to access the lower containers. When stacked, they tend to physically deform due to the excessive weight placed on top of them. Most storage containers are not designed to bear significant weight and withstand a sustained vertical load. Stacked storage containers can also be an unstable safety hazard when children play on or around the containers. Shelves and shelving units may be used to house storage containers. Shelves allow the containers to be raised off the ground and reduce the vertical load applied to each container. However, there are significant drawbacks to placing storage containers on shelves and shelving units. Even if most of the containers are raised off the ground, the shelves still take up valuable floor space. The shelves are also prone to collecting dust and dirt. Similar to the stacked containers, shelves are susceptible to being knocked over possibly injuring playing children. Keeping precariously positioned objects out of reach of small children is a significant concern of parents.

Some Do It Yourself ("DIY") projects do exist that allow containers to be mounted to the ceiling of a garage. These projects are typically made of wood and are assembled by the user. Completing these projects requires the user to have the proper power tools on hand, be familiar engineering principles, and have the proper knowledge and skill to safely assemble the wooden components. Even if these projects are safely completed, many are unsightly and some downright ugly. Furthermore, the fact that they are made from wood reduces their performance due to the increased friction created by the wood surfaces when a container is slid across them.

Other inventions have sought to solve the problem of how to create storage space on or adjacent the ceiling of a room. For instance, the system described in the US 2008/0036341 application uses mounting rails attached to a ceiling. However, the shape of the mounting rails is inferior for many reasons and does not sufficiently solve the problem of how to safely and efficiently create storage space on the ceiling of a room. For example, the system in the '341 application uses an "L"-shaped mounting rail that can be twisted or torqued when it is engaged with a storage container potentially spilling the container to the ground.

In addition, the lateral thickness of the unit precludes the ability to serially mount units directly onto standard spaced ceiling joists on the ceiling of a home or garage and still use common storage containers. More specifically, storage containers are manufactured by a wide variety of companies including Rubbermaid, Hefty, and CONTICO and come in generally standard sizes. A common sized plastic storage container or tub has typical dimensions of 16.5 inches tall, by 23.9 inches long by 15.9 inches wide. If the mounting structures are secured to standard 16 inch ceiling joists in standard construction, and the mounting structures are too thick, the container cannot be positioned between the mounting structures.

The system described in U.S. Pat. No. 7,597,203 suffers from similar fallbacks. In the '203 patent, the invention is a "rail-like storage unit" that uses joined metal rods. Since the head of the screw used to mount this system is so close to the ceiling, the screw adds no torsional support to the unit to resist torquing of the structure when under load by the container. Instead, the system relies solely on the metal rods to prevent the unit from becoming dangerously displaced during application of a storage container. In addition, the mounting elements are also wide which preclude these elements from being mounted on standard spaced joist and accommodating the commonly available and dimensioned storage containers currently on the market. Finally, if the mounting screw is not perfectly tight, the unit will have a tendency to wobble, increasing the risk of a storage container falling.

The public would benefit from a system that utilizes otherwise wasted space in their homes that is economical, easily installed, prefabricated, and versatile. This application seeks to address these concerns and desires by presenting an invention that is ready to install out of the box, is may be used in multiple formats, and integrates well with common home structures.

SUMMARY OF THE INVENTION

The storage system described herein is unique because it solves the problem of where to safely store storage containers, and does so using a safe and easy to use mountable track. The track is designed to be mounted on the ceiling of a room, such as in a garage or basement, and may be used with standard storage containers found in local supply stores.

In one embodiment for a hanger track assembly for storage containers, the storage containers include walls that define an interior space accessed by an opening and a flange having a height and a bottom surface. The flange is formed about the opening in such a way that the outer dimensions of the walls are less than the outer dimensions of the flange. The assembly comprises a first and second pre-formed hanger track that are each integrally formed. The first and second hanger tracks each include a planar surface that extends in a lengthwise direction and is contoured to be mounted to and to extend substantially parallel to a ceiling in a lengthwise direction. Each hanger track also comprises a vertical support that extends outward from the planar surface a distance that is greater than or equal to the height of the flange, and at least one retention surface that extends laterally outward from the vertical support a selected distance so that the bottom surface of the flange is retained on the retention surface when the first and second hanger tracks are mounted horizontally.

The first and second pre-formed hanger tracks may be formed of extruded plastic. The vertical supports may comprise two wall members that define an opening in the vertical support. If the hanging tracks comprise an opening, the opening may be sized so as to receive a member such as a mounting bracket extending horizontally from a wall in such a manner so as to retain the first or second vertical support in a substantially horizontal position.

An embodiment of the hanger track may have a vertical support that is of such a width so as to be mounted on standard joists positioned approximately 16 inches apart on center, and still be able to retain a standard size container between the two hanger tracks. In some embodiments the vertical support may be less than ½ inches. The length of some embodiments of the hanger tracks may be between 25 and 27 inches and the vertical supports of some embodiments may extend between 1.5 and 2.5 inches from the planar surface.

In some embodiments a securing surface is formed adjacent the retention surfaces, with the securing surface, the vertical support, and the planar surface being dimensioned so as to receive fasteners. The hanger tracks can be mounted to a ceiling by attaching fasteners through the securing surface, the vertical support, and the planar surface, and into part of the ceiling.

The hanger tracks may be mounted to joists such that the hanger tracks are substantially parallel to the joists. Alternatively, the hanger tracks may be mounted to joists such that the hanger tracks are parallel to each other, but at a different angle with respect to the joists. The joists may be 16 inches or 24 inches on center, or may be separated by another distance was well.

In another embodiment, two or more boards are mounted to joists of a ceiling, with the boards being substantially parallel to each other. In addition, two or more hanging tracks are mounted to the boards. In some embodiments the boards are mounted at right angles to the joist or the hanging brackets are mounted at right angles to the boards.

The hanger track assembly may further comprise a first and second vertical mounting surface supporting a first and second mounting bracket respectively. The first mounting bracket may engage the first hanger track and the second mounting bracket may engage the second hanger track, such that the hanger tracks are substantially parallel to each other and positioned substantially horizontal.

Some embodiments of the hanger track may include a rail with a trapezoidal cross-section that comprises at least one retention surface that is positioned to retain at least a portion of the flange. In addition, some embodiments may comprise a planar surface that is only present on one side of the vertical support.

In one method of storing storage container, the containers include walls that define an interior space accessed by an opening as well as a flange that has a height and a bottom surface. The flange is formed about the opening such that the outer dimensions of the walls are less than the outer dimensions of the flange. The method comprises the steps of: mounting a first hanger track extending substantially horizontal; mounting a second hanger track substantially horizontal, wherein the distance between an edge of the retention surface of the first hanger track is at a selected distance from an edge of the retention surface of the second hanger track, and the selected distance is greater than the distance between the walls of the container but less than the outer dimensions of the flange; positioning the container adjacent the end of the first and second hanger tracks; and sliding the container so that the bottom surface of the flange of the container is positioned on the retention surfaces of the first and second hanger tracks so that the container is suspended from the first and second hanger tracks.

The method may further comprise the steps of: mounting the first hanger track to a first joist; and mounting the second hanger track to a second joist, wherein the second hanger track is substantially parallel to the first hanger track.

The method may further comprise the steps of: mounting the first hanger track to a first and second joist; mounting the second hanger track to the first and second joist, such that the second hanger track is substantially parallel to the first hanger track.

The method may further comprise the steps of: mounting a first board to a first and second joist; mounting a second board to the first and second joist; mounting the first hanger track to the first and second board; and mounting the second hanger track to the first and second board, wherein the second hanger track is substantially parallel to the first hanger track.

The method may further comprise the steps of: mounting the first and second boards at substantially right angles to the first and second joists; and mounting the first and second pre-formed hanger tracks at substantially right angles to the first and second boards.

Finally, the method may further comprise the steps of: coupling a first mounting bracket to a first vertical mounting surface; coupling a second mounting bracket to a second vertical mounting surface; coupling the first pre-formed hanger track with the first mounting bracket; and coupling the second pre-formed hanger track with the second mounting bracket.

BRIEF DESCRIPTION OF THE DRAWINGS

FIG. 3B is a top perspective view of the embodiment of FIG. 3A after it is engaged with a wall bracket.

DETAILED DESCRIPTION OF THE PREFERRED EMBODIMENT

Figure 1:
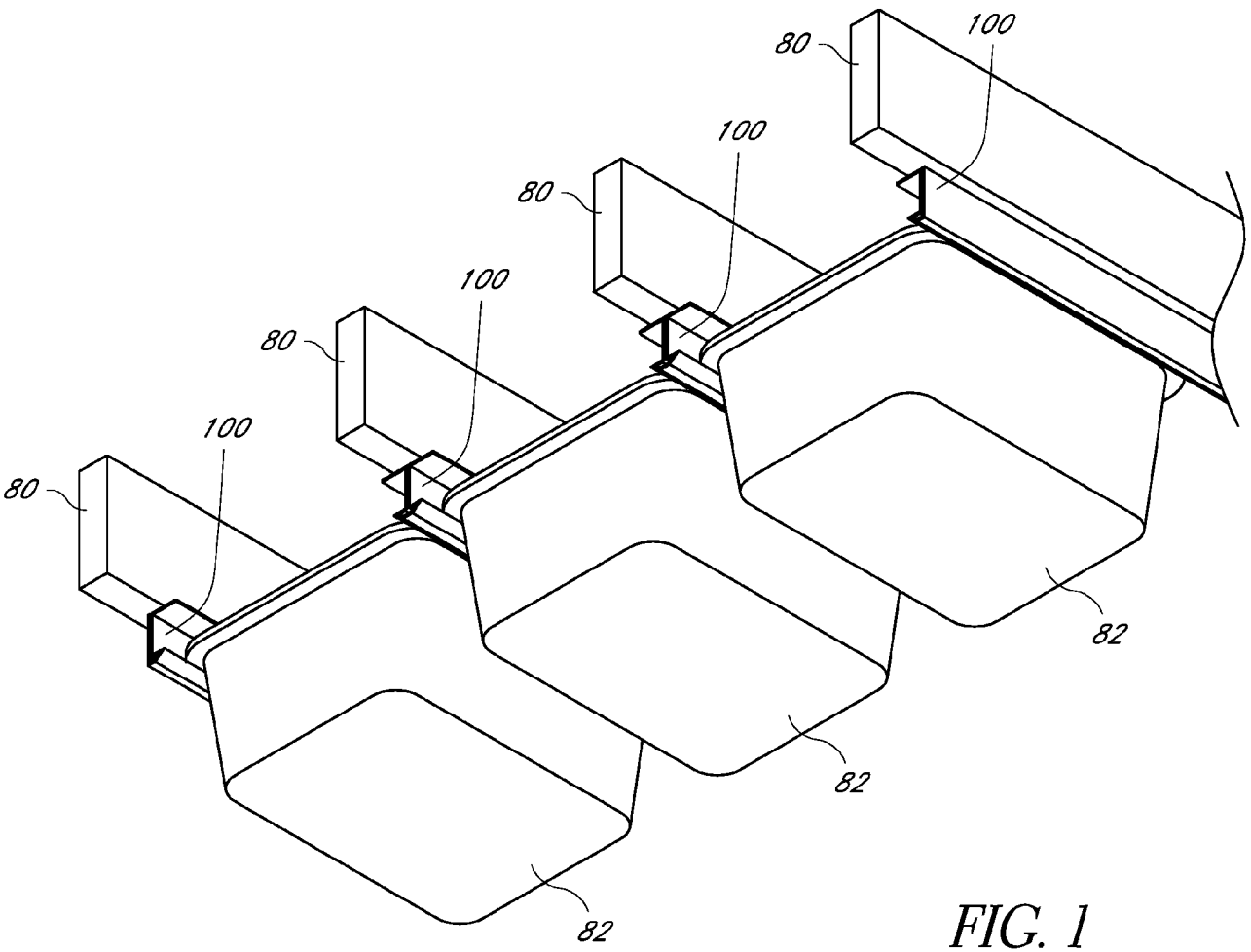
FIG. 1 is a bottom perspective view of a first embodiment of a storage assembly installed on joists on the ceiling of a room, with storage containers loaded thereon.

In FIG. 1, an embodiment of the track 100 is shown mounted to or adjacent the underside of a flat surface such as a ceiling of a building. The flat surface may be part of a garage, basement, storage room, or other part of a home, office, or storage structure where the user desires to increase storage space. The room may be finished (with plywood, sheetrock, or other board-like surface installed), unfinished (with exposed joists, beams, studs, or other structural components), or partially finished. Different embodiments of the invention allow the user to install the track 100 onto different portions of a structure. It is most desirable that the track 100 be installed onto a structural member that can adequately support the weight of the track 100, a container 82 supported by the track 100, and any cargo included in, on, or as part of the container 82. In one embodiment (as depicted in FIG. 1 as an illustrative example), a plurality of tracks 100 are installed on a plurality of joists 80 of a garage. Containers 82 may be positioned and then suspended between the tracks 100 and serve as storage space.

Figure 2:
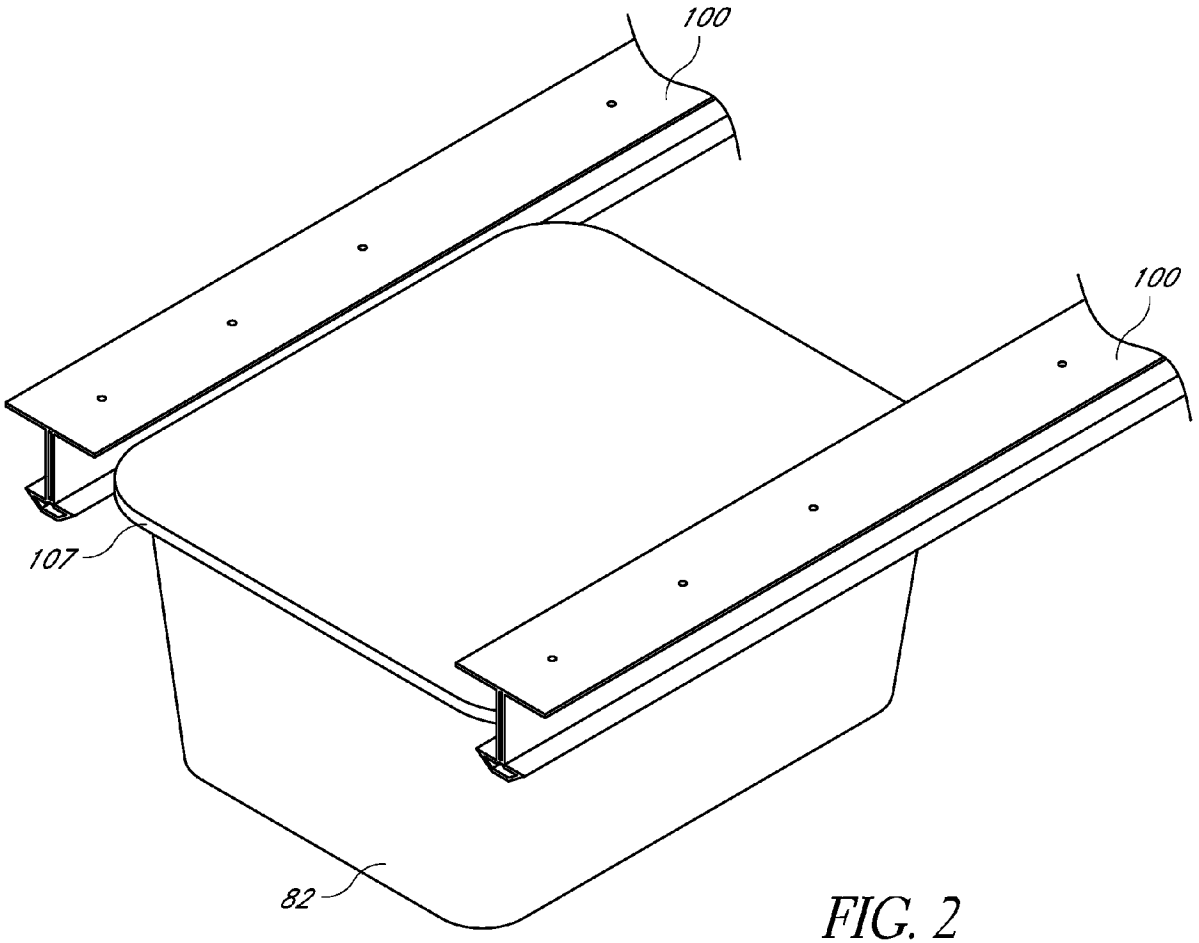
FIG. 2 is a top perspective view of a storage assembly and storage of FIG. 1.

FIG. 2 shows a top perspective of a storage container 92 suspended between two tracks 100. As discussed above, the storage container 92 is a typical storage container such as those available from Lowe's, Home Depot, or Wal-Mart and have typical dimensions of approximately 16.5 inches tall, by 23.9 inches long by 15.9 inches wide. In one embodiment, the container 82 is a Rubbermaid 18-Gallon Roughneck Storage Box available at the above listed stores. It will, however, be appreciated that the configuration and dimensions of the system can be varied by those skilled in the art without departing from the spirit and scope of the present invention.

By mounting the tracks 100 on or adjacent the ceiling or even just in an elevated fashion, storage containers 82 may be elevated and supported away from the floor. This location has many advantages. First, it allows the storage containers 82 to be removed from the ground where dust and debris settle, in addition to water from an occurrence such as a flood or broken pipe. Second, it allows the storage containers 82 to not be stacked on top of each other, thus preserving their structural integrity and allowing them to be individually accessed without disturbing other containers 82. Third, elevating the storage containers 82 up off the ground keeps them out of reach of small children who can climb on and get into them, risking frustration, disorganization, and safety. Finally, locating the storage containers 82 in an elevated fashion frees up valuable floor and wall space that may then be used for a multitude of other purposes.

Figure 3A:
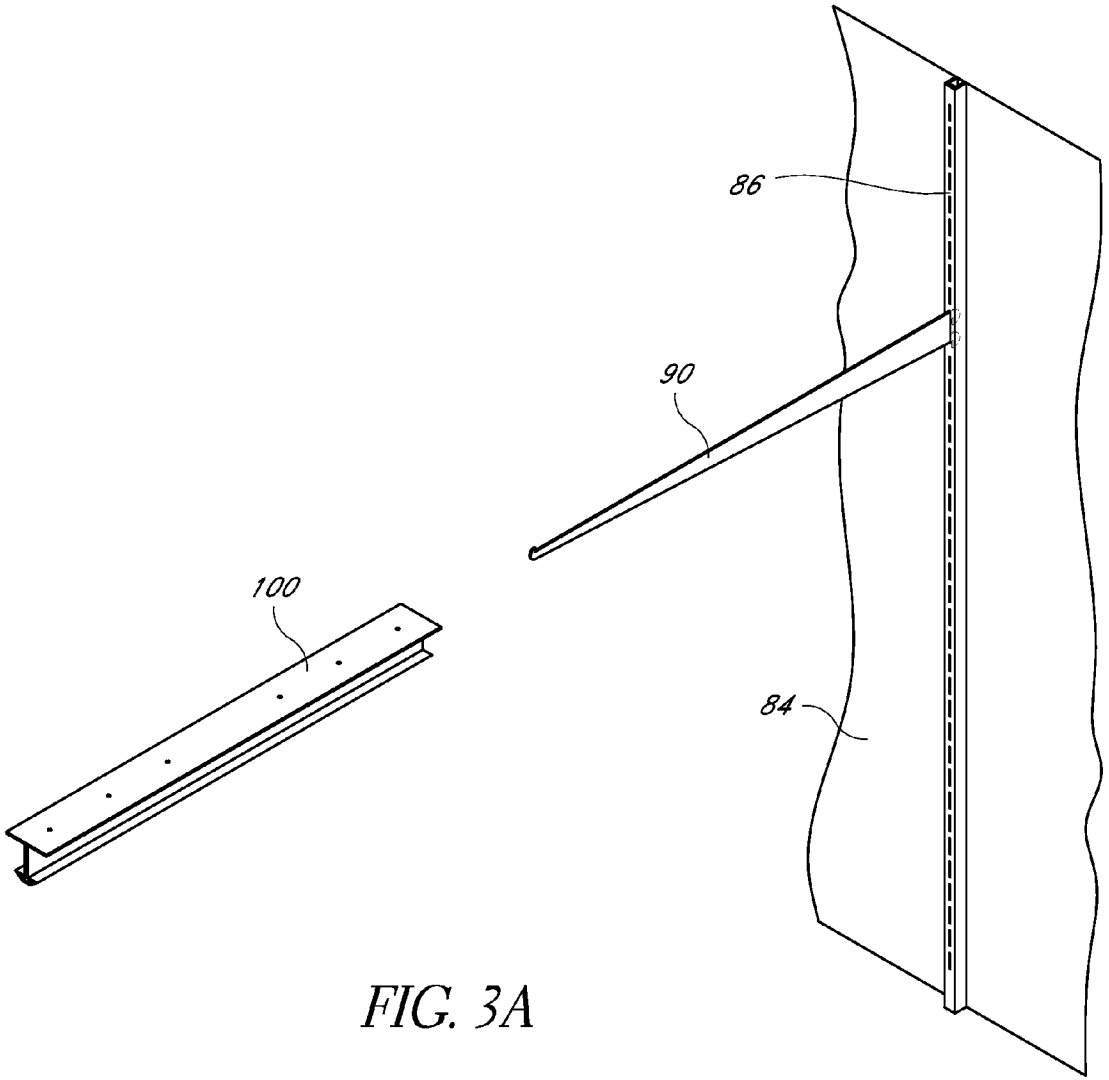
FIGS. 3A-3C are a top exploded and assembled perspective view of another embodiment of a storage assembly that is mounted on a wall and extends horizontally outward from the wall.
Figure 3B:
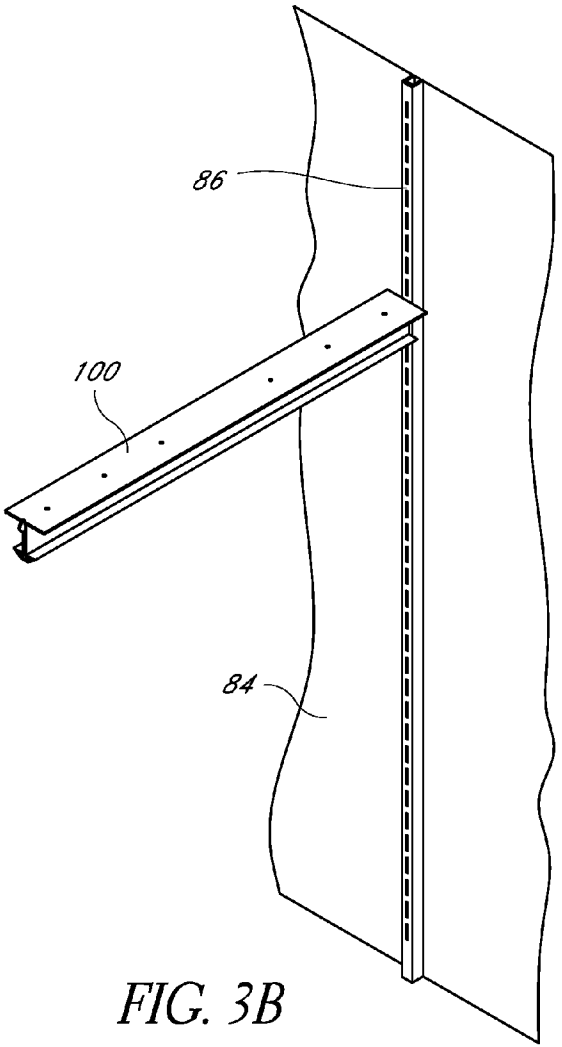
Figure 3C:
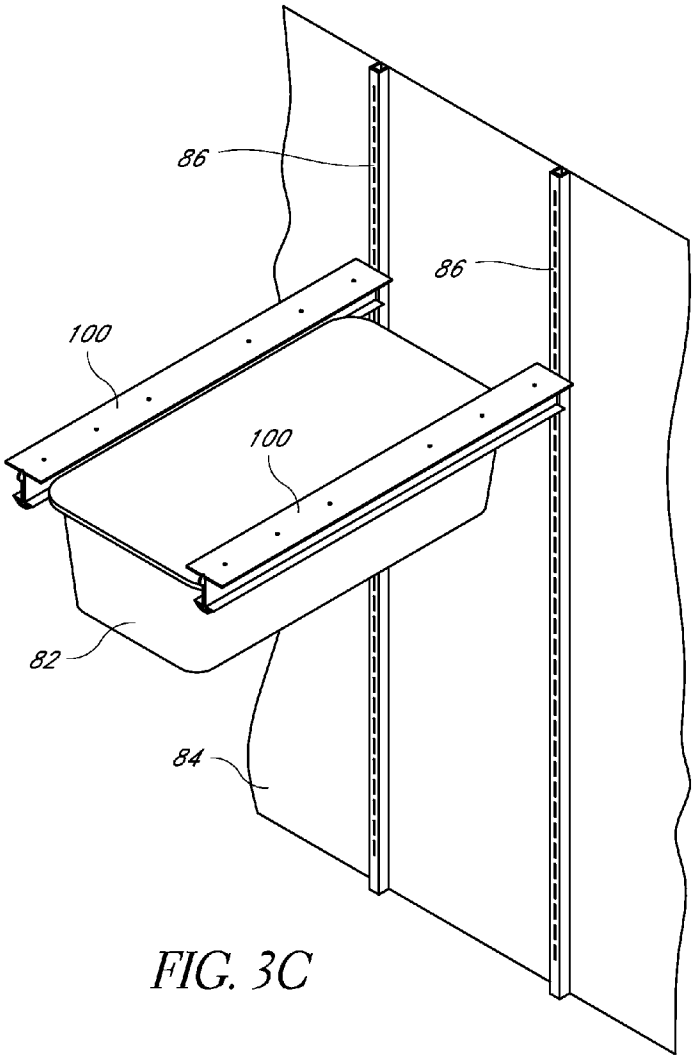

In another application shown in FIGS. 3A-3C, the track 100 may be mounted on a wall 84, or another vertically extending structure so as to extend horizontally outward therefrom. In one embodiment, a wall 84 comprises a vertical strip 86 configured to support a shelf bracket 90 in a well-known manner. The shelf bracket 90 attaches to the vertical strip 86 and extends horizontally. One embodiment of the track 100 comprises a vertical support 106 with an opening 112 that will be described in greater detail herein below. The track 100 may be able to horizontally slide over the shelf bracket 90, towards the wall 84, with the shelf bracket 90 being inserted into the opening 112 within the track 100. If the shelf bracket 90 is long enough, it may emerge from the opposite end of the track 100. Repeating this with another track 100 on another shelf bracket 90 attached to another vertical strip 86 in the manner shown in FIG. 3C may create two tracks 100 being horizontally level and parallel and create a system to support a storage container 82 in an elevated fashion off of the floor so that the storage container 82 extends outward from the wall 84 in a cantilevered fashion. This may be repeated vertically utilizing the same vertical strips 86 to maximize the space savings. The track 100 is designed to work in conjunction with readily available shelf brackets 90, which are available at most home improvement stores, making implementation of the track 100 simple.

Referring now to FIGS. 4A-4F and 6A, one embodiment of a track 100 will now be described. The track 100 comprises a base 102, a rail 104, and a vertical support 106. In one embodiment, the base 102 is relatively flat and thin and extends laterally from the center of the base 102. When this embodiment is mounted to a portion of a ceiling or joist 80 or other structural support member in the manner shown in FIG. 1, the width of the base 102 provides stability and resistance to torque when a container 82 is inserted in between two tracks 100. More specifically, the weight of the storage container 82 exerts a downward force against the rail 104 inducing a rotational force against the rail 104. However, the base 102 extends laterally outward from the centerline of the track 100 and the engagement of the laterally extending portions of the base member 102 against the joist resists the rotational forces induced by the weight of the storage container 82.

As shown in FIGS. 4A-4F and 6A, the rail 104 has two generally flat retention surfaces 105*a*, 105*b* that may accommodate a flange 107 (See, FIGS. 1 and 2) of the container 82, but other profiles may suffice. A flat surface, however, allows for the storage containers 82 to be easily slid along the rail 104. The bottom surface 109 of the rail 104 may comprise many shapes. In one embodiment, the cross-section of the rail 104 has angled sides and a generally flat bottom, forming a trapezoidal shape. This profile allows for structural stability but with minimal material used. If the rail 104 was a single flat piece with the no difference in height between the middle and the edges, the strength of the rail 104 would be decreased and there would be a greater probability of failure of the rail 104, resulting in the suspended container 82 becoming dislodged and possibly injuring the user. By forming the rail 104 in a trapezoid or similar shape, a second piece of material is added to help support the suspended container 82. Moreover, the edge 113 of the rail is then reinforced with more material which makes the edge less susceptible to bending due to the weight of the storage container 82 over time. The rail 104 may be solid or may contain an opening 110 depending on the application or other criteria. If the rail 104 contains an opening 110, another component may be inserted into this area to provide for greater structural integrity. A rail 104 comprising an opening 110 may also comprise a gap 116. Such a gap 116 may be located on the upper surface 119 of the opening 110 and continue along at least part of the length of the rail 104.

The vertical support 106 connects the base 102 to the rail 104 and may comprise an opening 112 through at least part of the vertical support 106. In some embodiments the opening 112 may be used to mount the track 100 close to a wall 84 or other structure that contains a horizontally extended support member in the manner described above in conjunction with FIGS. 3A-3C. In other embodiments, the vertical support 106 may be solid or may be comprise a second material. The vertical support 106 is relatively thin in width in order to allow adjacent containers 82 to be stored as closely as possible to each other. This system works well with common storage containers and common home structures as will be described later on. However, the thickness of the vertical support 106 may be increased depending on the size of the containers 82 used. The smaller the containers 82, the thicker the vertical support 106 can be. However, to facilitate mounting a standard storage container 82 having the dimensions discussed above on joists that are spaced on 16 inch centers, the thickness of the vertical supports 106 should preferably be less than ½" and may be ¼" or less. If the vertical support 106 is too thick, it cannot accommodate the commonly available storage containers while the rails 100 are mounted to standard 16 inch spaced joists which would necessitate the addition of additional mounting structures in the manner that will be described in greater detail below.

FIGS. 4A-F and 6A depict one embodiment where the base 102 and rail 104 are on both lateral sides of the vertical support 106 and can thus accommodate storage containers 82 on each of the retention surfaces 105*a* and 105*b* in the manner shown in FIG. 1. FIGS. 5A-G and 6B depict an embodiment 100 where the base 102 and rail 104 are only on one lateral side of the vertical support 106 and have only a single mounting surface 105*a*. The first embodiment of the track 100 is useful for when a storage container 82 will be placed on both sides of the track 100 since the rail 104 can accommodate two separate containers 82. The second embodiment of the track 100 is useful for when only one storage container 82 will be suspended thereon. The second embodiment may be useful for when a storage container is to be positioned adjacent a wall. The second embodiment may also be used to support the last container 82 in a row of containers 82 when the user prefers a more finished look in the manner shown in FIG. 1. By omitting part of the base 102 and rail 104, the exposed side is clean-looking and does not have extraneous parts exposed. In yet another embodiment, the base 102 is on both lateral sides of the vertical support 106, but the rail 104 is only on one side of the vertical support 106.

Figures 4A, 4B, 4C:
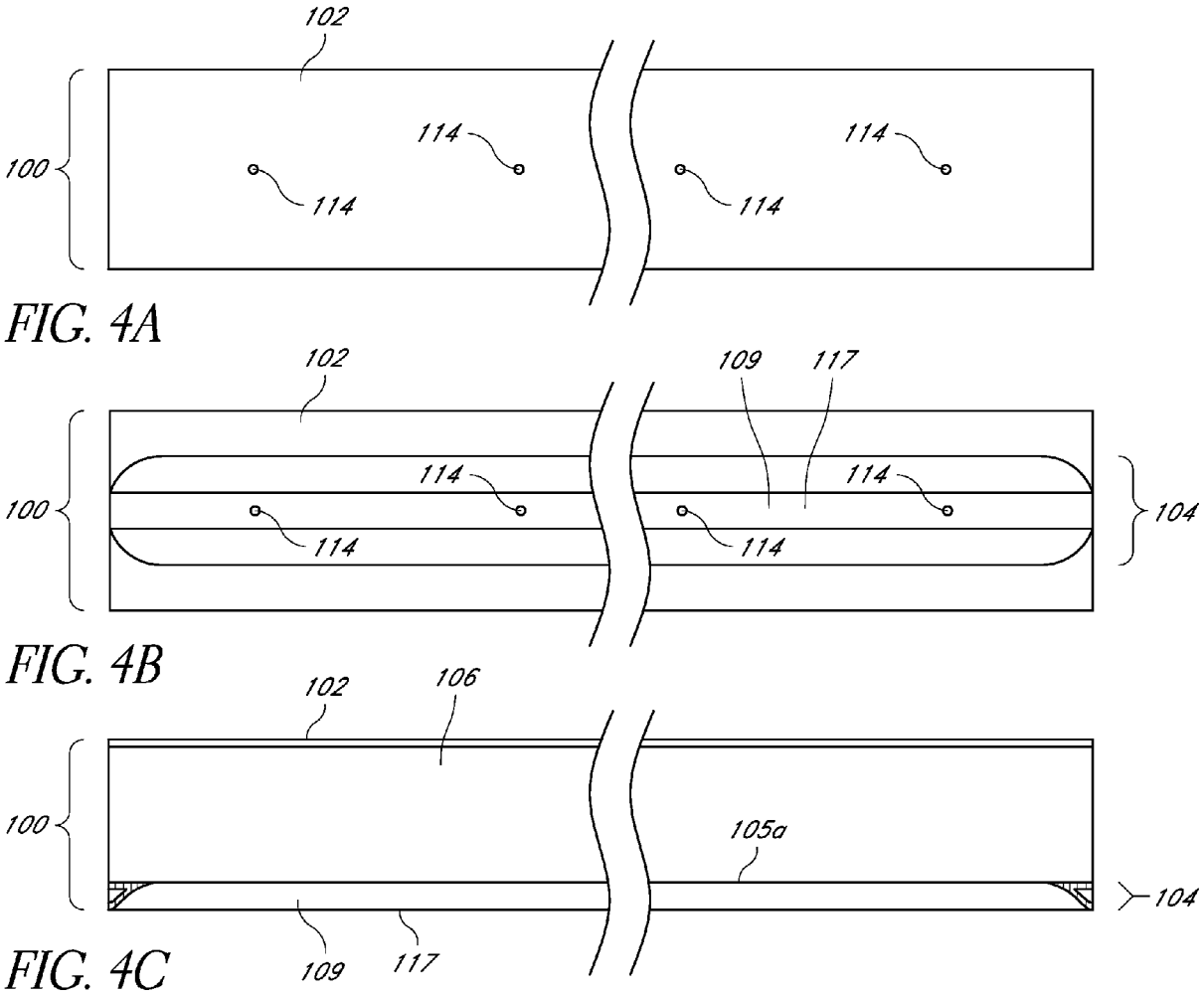
FIGS. 4A-4F are a top, bottom, side, end and cross sectional views of an embodiment of a storage member of the storage assembly of FIGS. 1 and 3A.

FIGS. 4A and B show the top and bottom of one embodiment with the base 102 having a generally rectangular shape. Pre-formed holes 114 are disposed towards the middle of the base 102. In the depicted embodiment the ends of the rail 104 are rounded to reduce sharp edges and to help guide a storage container 82 into the correct position during use. FIG. 4C shows the side of one embodiment with the vertical support 106 connecting the rail 104 to the base 102. The vertical support 106 may have holes or other openings that communicate one side of the embodiment to the other side (not shown).

Figure 4F:
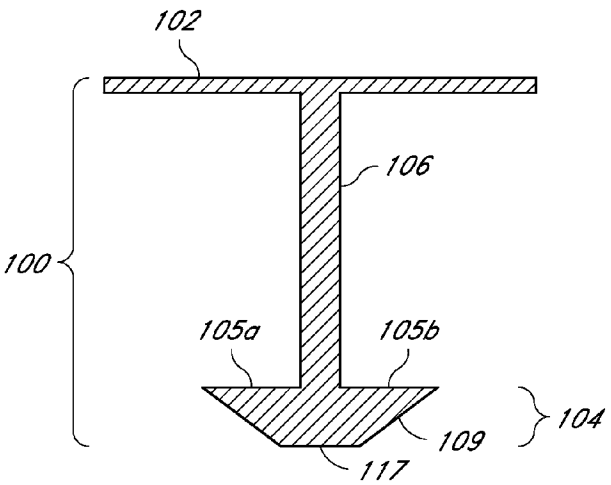
Figure 4E:
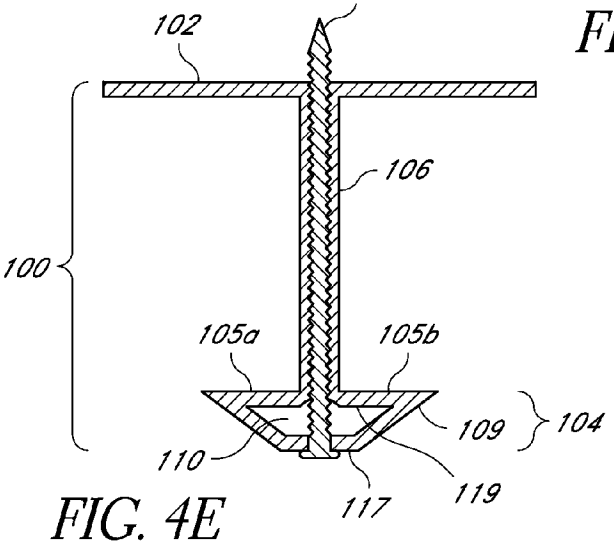
Figure 4D:
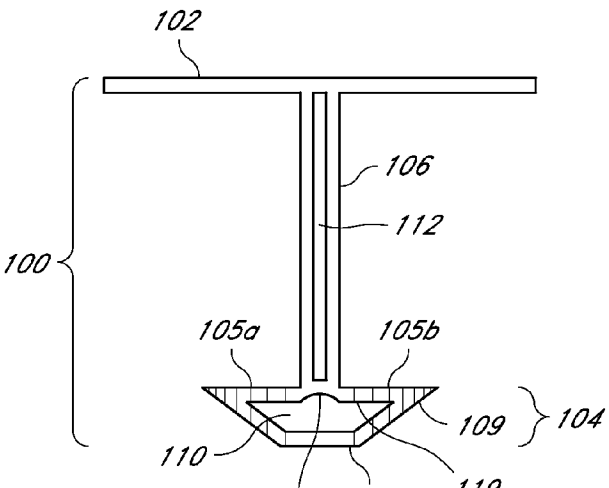

FIG. 4D shows an end of the track 100. As depicted and as discussed above, this embodiment comprises an opening 110 in the rail 104 and an opening 112 the vertical support 106. Other embodiments may lack either or both of these openings. Viewing the track 100 from the opposite end may look substantially similar to the end view shown. FIG. 4E shows a cross-section of an embodiment that comprises an opening 110 in the rail 104, an opening 112 in the vertical support 106, and a fastener 94 disposed vertically in the track 100. FIG. 4F shows a cross-section of an embodiment that lacks openings in both the rail 104 and the vertical support 106.

In one embodiment the cross-section of the track 100 is substantially uniform throughout its length. In another embodiment, the cross-section of the track 100 is not uniform throughout its length. One difference in cross-section may be due to pre-formed holes 114 disposed vertically in the track 100, extending from the rail 104 through the vertical support 106 and through the base 102. The pre-formed holes 114 may be created during the initial manufacturing process, or may be created at a later stage. In one embodiment, the pre-formed holes 114 are drilled after the track has been initially formed.

The pre-formed holes 114 that extend from the rail 104 through the base 102 accommodate a fastener 94 that adds torsional rigidity to the track 100. Some other systems are mounted to the ceiling of a room using a screw that only contacts the very top of the unit. In those systems, the minimal contact of the screw with the mounted unit means that if the screw is not tightened securely, the mounted unit will wobble from side to side. Even if the unit is securely attached to the ceiling, the only material between where the screw attaches to where the container rests is the mounting unit itself. However, referring to FIG. 4D, a screw is inserted through a bottom most surface 117 of the rail 104, a surface 119 that is interposed between the rail 104 and the vertical member 106 and the base member 102. Thus, a screw in the instant embodiment reinforces the interconnection between the various components of the track 100. Such a fastener 94, which contacts the rail 104, and may contact the vertical support 106 or the base 102, adds rigidity to the track 100. Since the fastener 94 contacts the track 100 in multiple locations, the track 100 is prevented from rotating independently of the fastener 94.

Figure 5A:
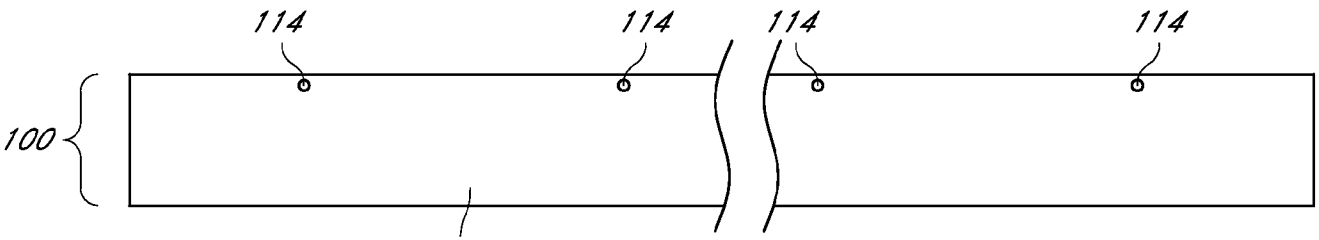
FIGS. 5A-5G are top, bottom, side, end and cross sectional views of another embodiment of a storage member of the storage assembly of FIGS. 1 and 3A.
Figure 5B:
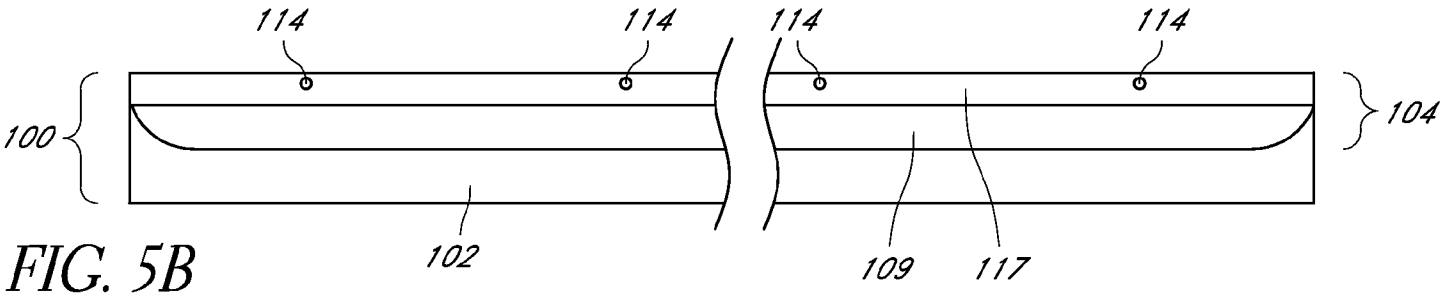
Figure 5C:
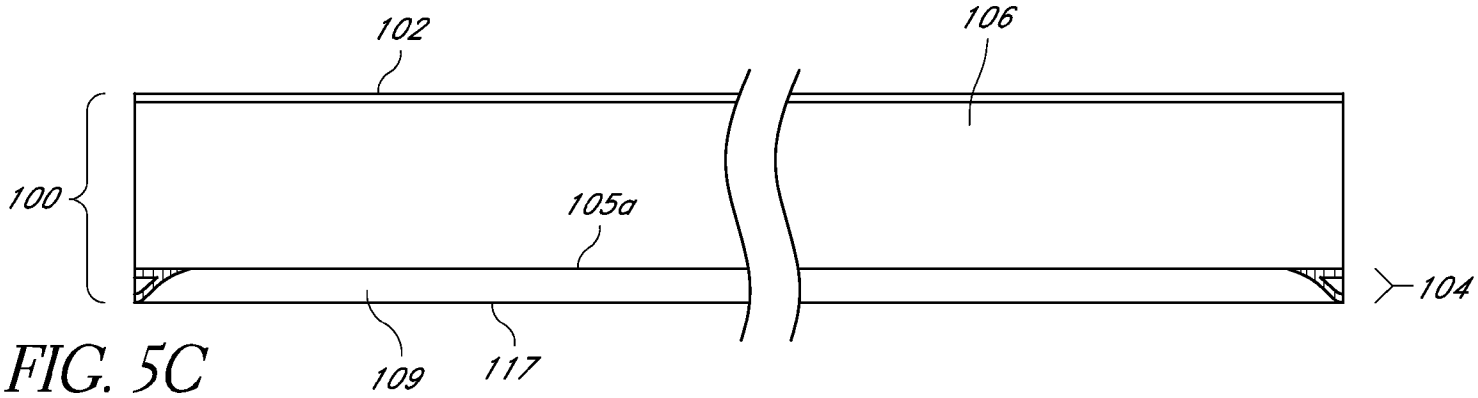
Figure 5D:
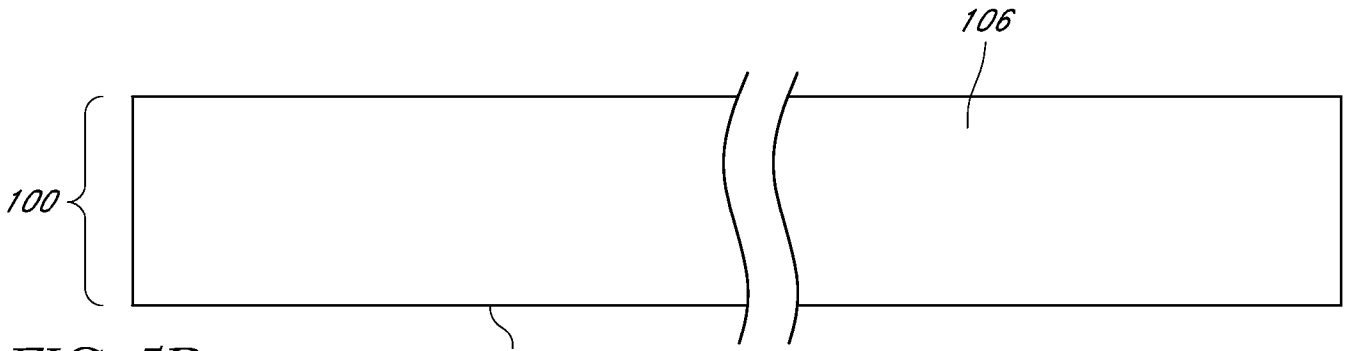

FIGS. 5A and B show the top and bottom of the embodiment of the track 100 discussed above suitable for mounting adjacent a wall or as an end member where part of the base 102 and rail 104 are omitted. Here, pre-formed holes 114 are located towards the edge of the base 102 and the holes 114 extend through the vertical support 106 and rail 104. FIG. 5C shows a first side of this embodiment of the track or support member 100. As shown from this viewpoint, the track 100 may be indistinguishable from an embodiment that does not omit portions of the base 102 and rail 104 (e.g., FIG. 4C). FIG. 5D shows a second side of an embodiment where part of the support member 100 has been omitted. As shown from this viewpoint, the base 102 and rail 104 are on the far side and are not visible. This embodiment is most beneficial when used at the end of a row of containers 82, such as up against a wall. Alternatively, the user may prefer to have the track 100 at the end of a row to have a cleaner more finished look. By omitting portions of the base 102 and rail 104, unnecessary parts of the track 100 are removed resulting in a more professional appearance.

Figure 5G:
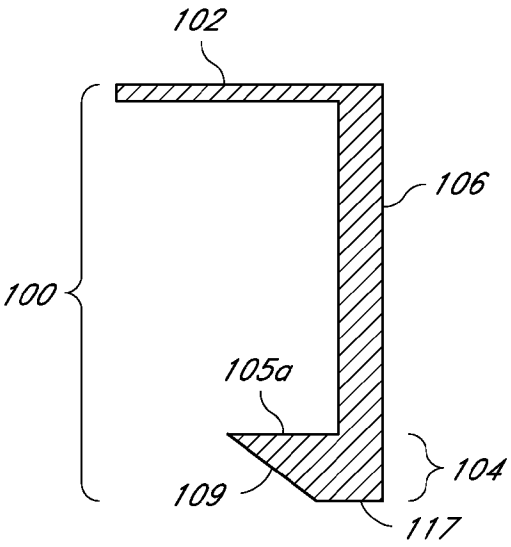
Figure 5F:
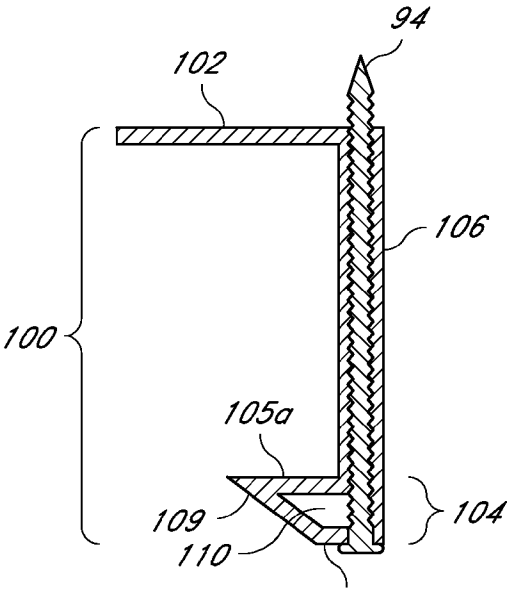
Figure 5E:
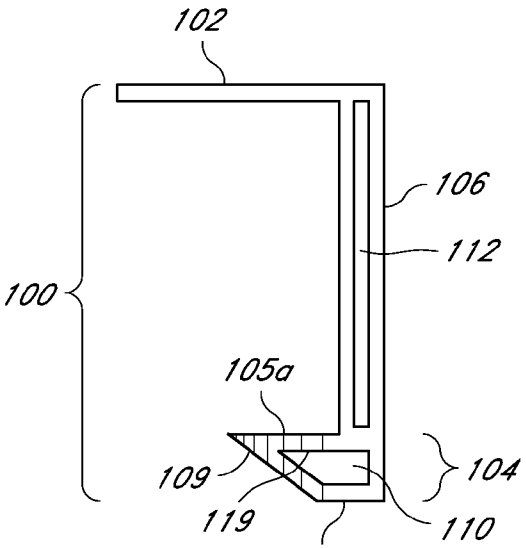
Figure 6B:
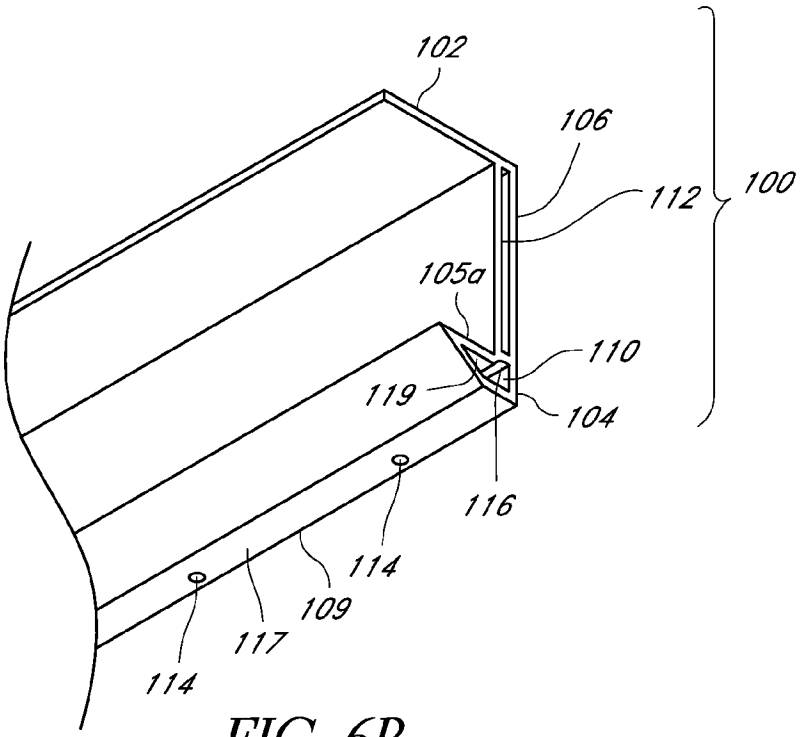
FIG. 6B is a bottom perspective view of the storage member of FIGS. 5A-5G.
Figure 6A:
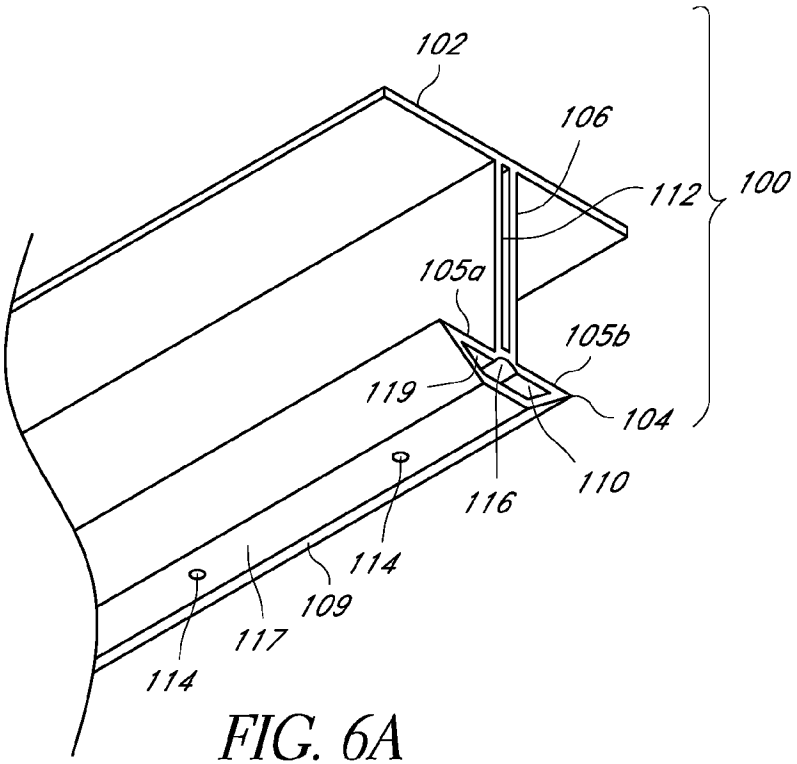
FIG. 6A is a bottom perspective view of the member of storage member shown in FIGS. 4A-4F.

FIG. 5E is an end view of an embodiment of the track 100. As depicted, this embodiment comprises an opening 110 in the rail 104 and an opening 112 in the vertical support 106. Other embodiments may lack either or both of these openings. Viewing the track 100 from the opposite end may look substantially similar to a mirror image of the end view shown. FIG. 5F shows a cross-section of an embodiment with part of the base 102 and rail 104 omitted that comprises an opening 110 in the rail 104, an opening 112 in the vertical support 106, and a fastener 94 disposed vertically in the track 100. The cross-section of the track 100 is generally uniform throughout the length of the track 100, but deviations from the depicted cross-section may be present without the utility of the track 100 being affected. FIG. 5G shows a cross-section of an embodiment that lacks the openings in both the rail 104 and the vertical support 106. The track 100 mounts with fasteners 94 in the same fashion as described above with the track 100.

Figure 7A:
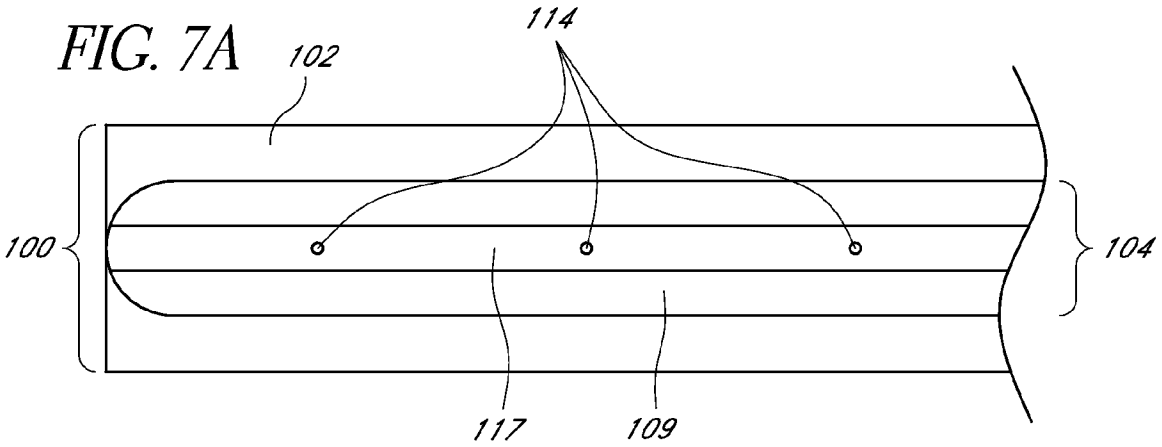
FIGS. 7A-7C are bottom views of an end of a storage member illustrating that the end can be contoured in different fashions.
Figure 7B:
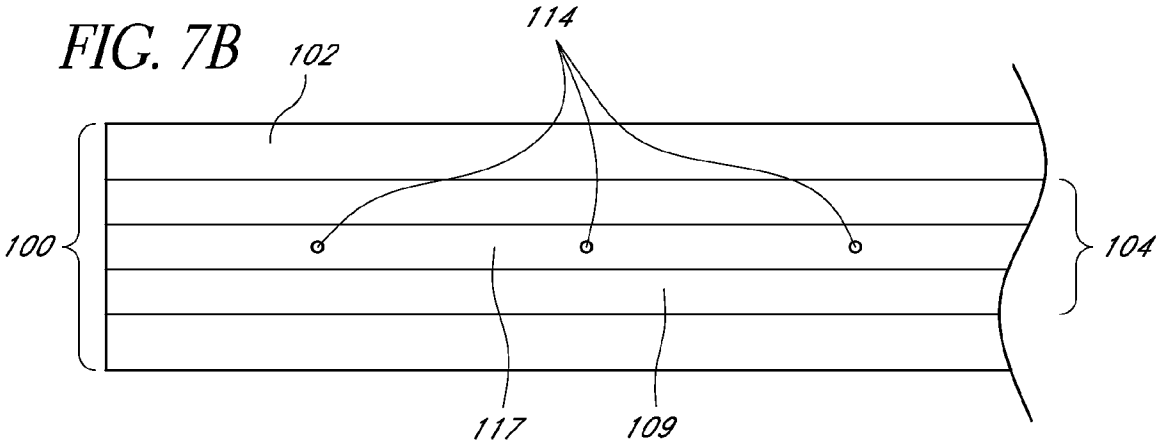
Figure 7C:
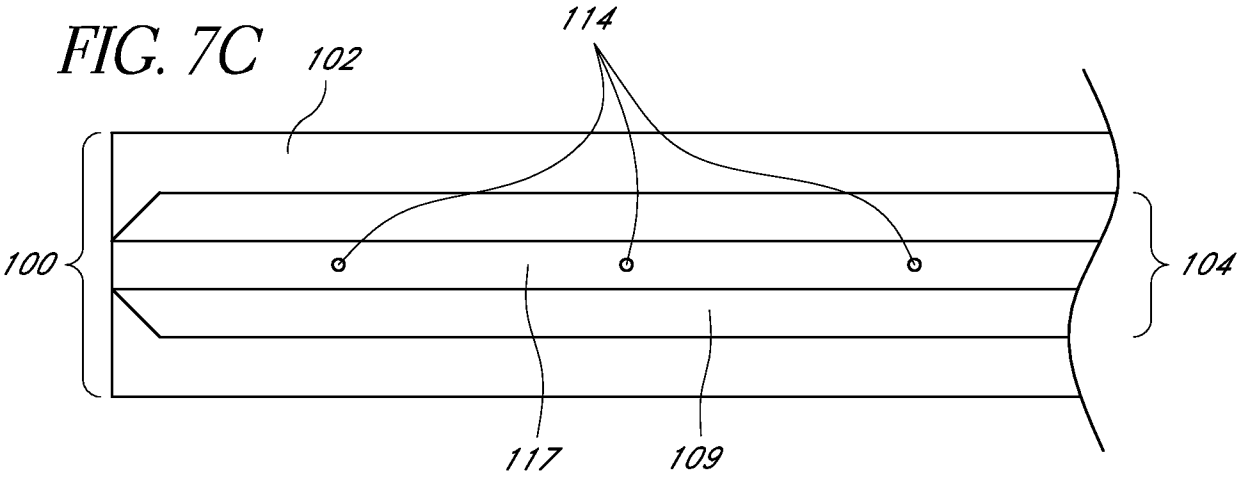

FIG. 7A shows the bottom of an embodiment where an end of the rail 104 has been rounded at the corners. The corners of the rail 104 may be rounded to save material, reduce sharp edges, or to help guide the container 82 into the track 100 during use. FIG. 7B shows the bottom of an embodiment where the end of the rail 104 has not been rounded at the corners (similar to embodiment in FIG. 6A). FIG. 7C shows the bottom of an embodiment where an end of the rail 104 has mitered or angled corners. These embodiments are only included as illustrative examples of how an end of the rail 104 can be modified to better suit various applications and criteria. Other embodiments may be possible.

The tracks 100 may be made in various lengths. In one embodiment the track 100 is between 6 inches and 6 feet long. In another embodiment, the track 100 is between 18 inches and 30 inches long. Similarly, the base 102 may be made in various widths. In one embodiment the base 102 is between 0.75 inches and 6 inches wide. In another embodiment the base 102 is between 2 inches and 3.5 inches wide. Next, the vertical support 106 may be made in various widths (as measured from one side of the vertical support to the other side of the vertical support). In one embodiment the vertical support 106 is between ⅛ inches and ½ inches thick. Finally, the track 100 may be made in various heights (as measured from the top of the base 102 to the bottom of the rail 104). In one embodiment the track 100 is between 1 inch and 8 inches high. In another embodiment the track 100 is between 1.5 and 3 inches high.

The track 100 may be made from a variety of materials, which may include plastics, metals, or wood. Additionally, the track 100 may be comprised of more than one type of material depending on the application. In one embodiment, the track 100 is comprised of plastic. An embodiment comprising a plastic rail 104 may have two generally flat retention surfaces 105*a*, 105*b* that are relatively friction-resistant, making it easier for a user to slide part of a container 82 across the surfaces 105*a*, 105*b* of the rail 104. In another embodiment, the track 100 is made from a first material and part of the rail 104 comprises a second material such that the rail 104 has reduced friction even through the rest of the track 100 may be comprised of a different material.

The track 100 may be made by standard manufacturing techniques. If the track 100 comprises plastic, it may be extruded and then cut to the desired length or may be made by injection molding to the finished size. In one embodiment the track 100 is created by extruding plastic to create an integrally formed unit. After the track has been initially formed, pre-formed holes 114 may be added in various locations. Other manufacturing techniques may be added, substituted, or combined and still produce the same results. If the track 100 comprises metal, it may be extruded and then cut to the desired length, cast as a single piece, or may be assembled using separate parts.

The track 100 may be installed in any manner that adequately affixes the track 100 to a stable structural member. Structural members may include boards, straps, joists, beams, rafters, studs, plywood, or any other object that adequately prevent the track 100 from moving. If the structural member is not immediately visible, a location device, such as a stud finder, may aid in locating an appropriate structural member. In one embodiment, the track 100 comprises holes 114 that allow for a fastener 94 to securely attach, directly or indirectly, a portion of the track 100 to a structural member. It will be understood that the holes 114 can be pre-drilled at specific locations or can be drilled or formed as needed by the installer to accommodate the different spacing of structural members to which the tracks 100 are to be attached. A fastener 94 may include a screw, nail, bolt, or other similar object. A second fastener 94 may be used to attach another portion of the same track 100 to the same or different structural member. A second track 100 may then be attached to one or more structural members, such that the second track 100 is substantially parallel to the first track 100. If the tracks 100 are attached to a linear structural member, such as a joist 80, the tracks 100 may be parallel to the joists 80, perpendicular to the joists 80, or at a different angle.

Figure 8:
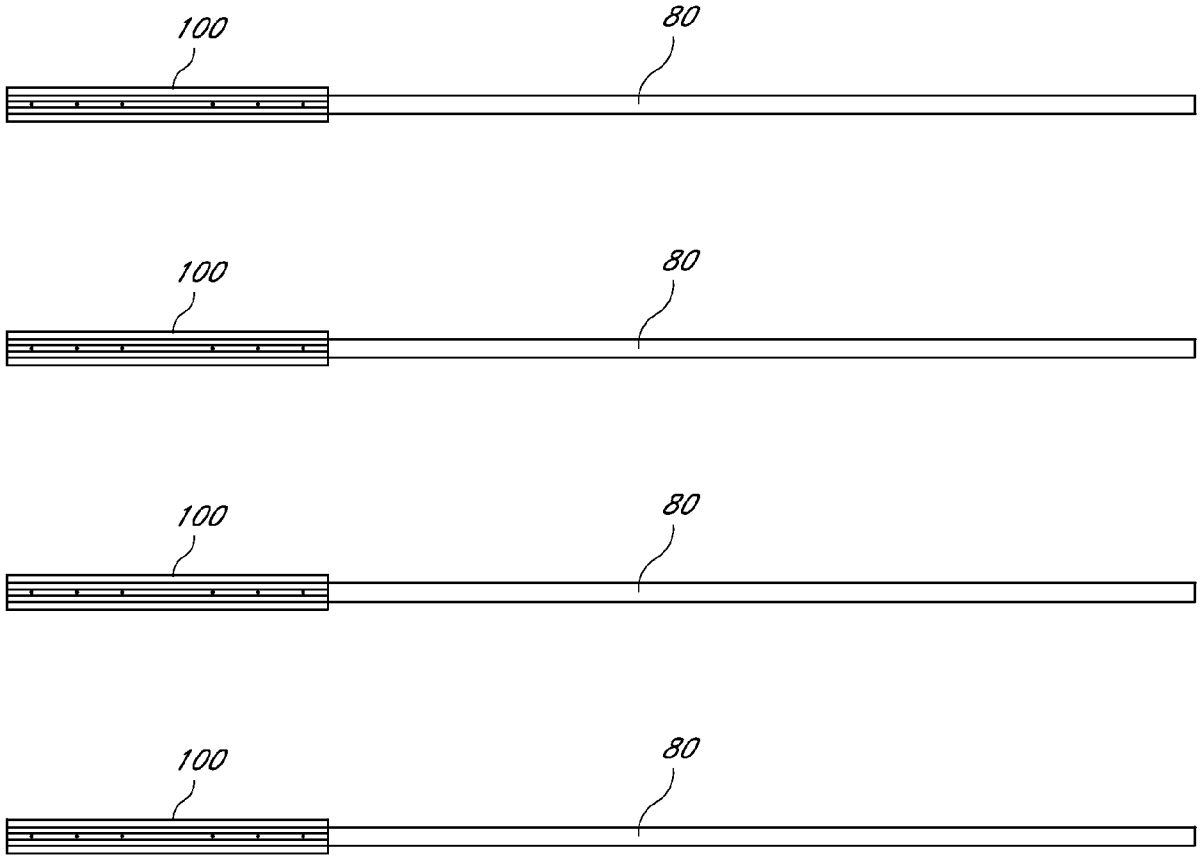
FIG. 8 is a bottom view of how storage members can be attached in parallel to spaced ceiling joists.

In one embodiment, shown in FIG. 8, a first track 100 is attached to a first joist 80 and parallel to the first joist 80, with at least one fastener 94. A second track 100 is then attached to a second joist 80, parallel to the second joist 80 with at least one fastener 94. A container 82 (not shown in FIG. 8) may then be placed in the space between the first and second tracks 100. The distance between the first and second tracks 100 is largely dictated by the distance between the joists 80. Since many homes and garages use joists 80 that are spaced either 16 inches or 24 inches on center, the distance between the two tracks 100 would also be 16 inches, 24 inches, or some multiple of either one. The distance between the joists 80 and of the tracks 100 may have some influence on the size of containers 82 that can be supported by the tracks 100. In an embodiment, the joists 80 are spaced at a distance of 16 inches on center and the container is a Rubbermaid 18-Gallon Roughneck Storage Box, available at most home improvement stores.

Figure 9:
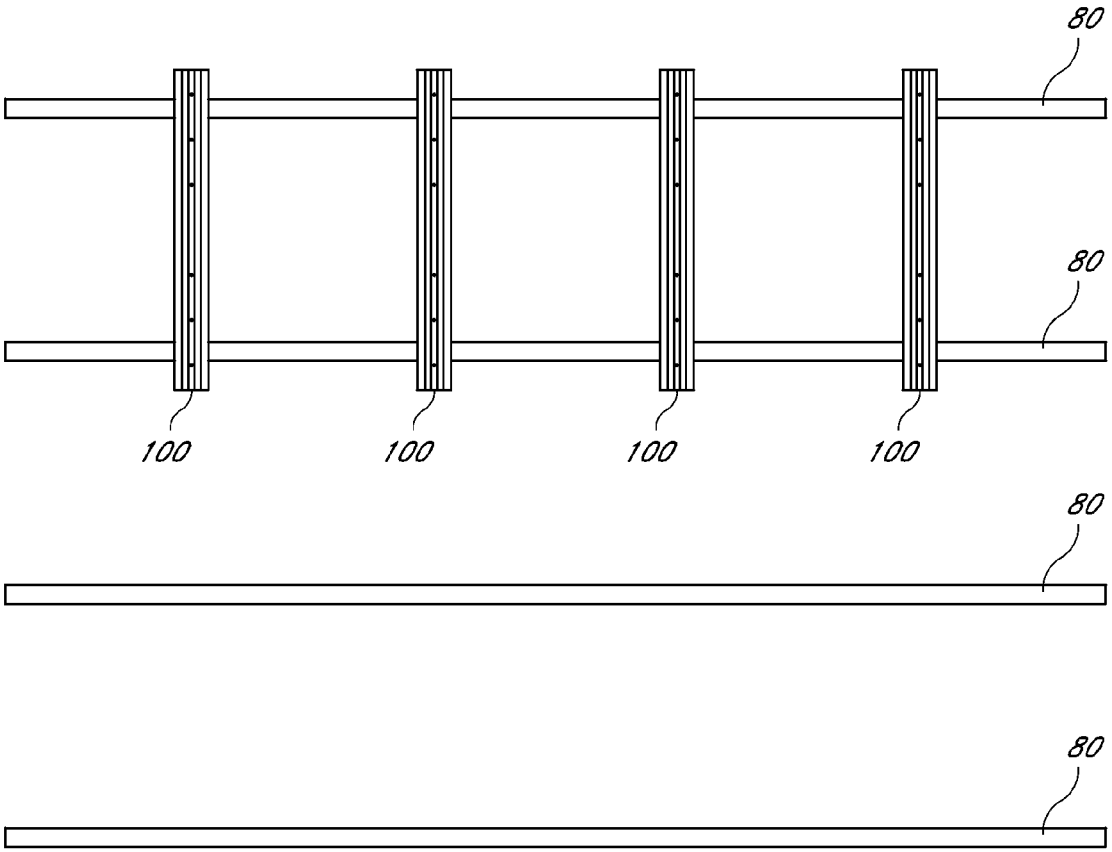
FIG. 9 is a bottom view of how storage members can be attached perpendicular to a collection of spaced ceiling joists.
Figure 10:
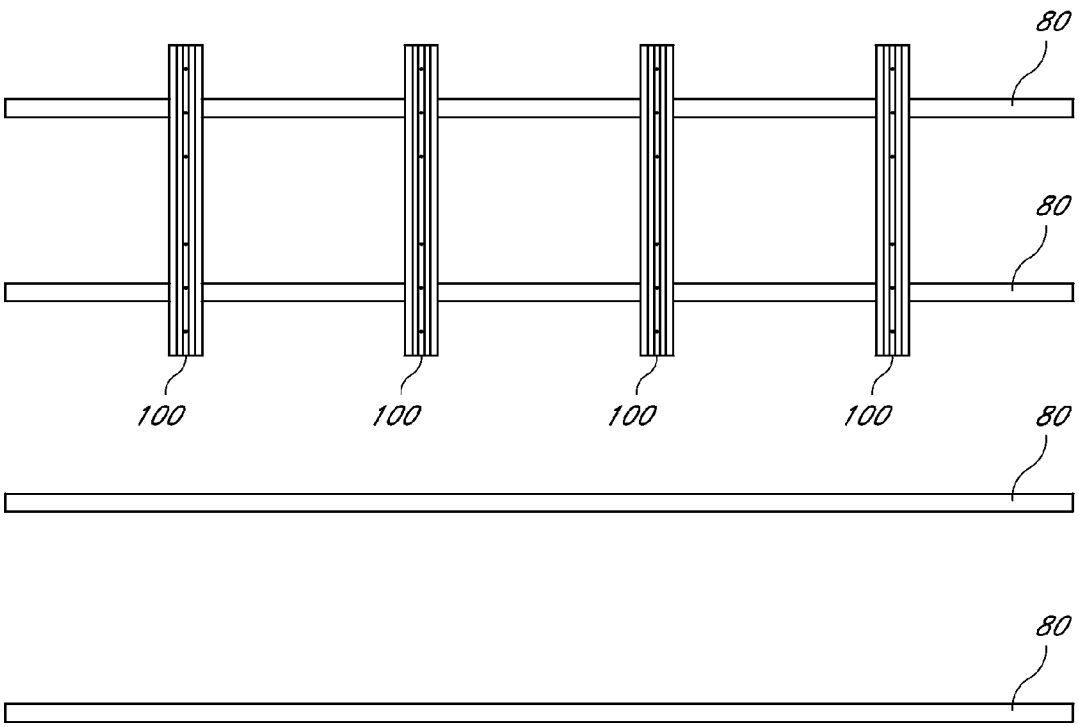
FIG. 10 is a bottom view of how storage members can be attached perpendicular to a collection of narrowly-spaced joists.

In another embodiment, shown in FIG. 9, a first track 100 is attached perpendicularly to a first joist 80, and then attached perpendicularly to a second joist 80. This is repeated with a plurality of tracks 100. When the tracks 100 are positioned as depicted in FIG. 9, a space between two tracks 100 is created that can house a storage container 80. The holes 114 in the track 100 may be pre-formed so as to be spaced at a set interval. In one embodiment, the distance between pre-formed holes 114 is 8 inches. In another embodiment, the distance is 16 inches. In yet another embodiment the distance is 24 inches. In another embodiment, the holes may be drilled or formed in locations as needed for the particular installation. The embodiment shown in FIG. 9 comprises pre-formed holes 114 at a spacing that can accommodate joists 80 that are 24 inches on center. The embodiment in FIG. 10 comprises pre-formed holes 114 at a spacing that can accommodate joists 80 that are 16 inches on center. Other spacing intervals may be more advantageous depending on the specific application.

Figure 11:
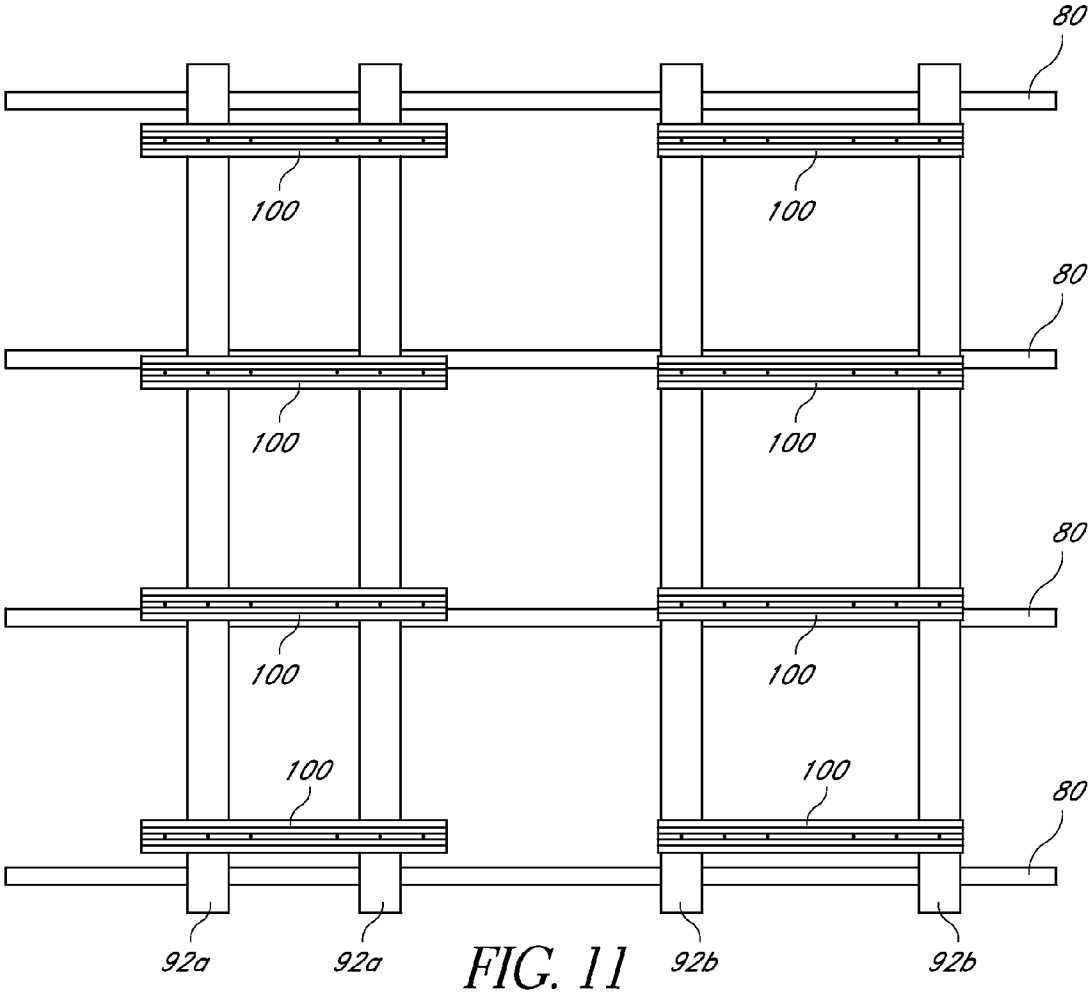
FIG. 11 is a bottom view of how storage members can be attached perpendicular to several straps that are attached perpendicular to a collection of widely-spaced joists.

Straps 92*a*, 92*b*, including boards and other structural members, may be attached to the joists 80 and the tracks 100 may be attached to the straps 92*a*, 92*b*. This may be done when the distance between the joists 80 is different from the desired distance between the tracks 100, when the distance between the joists 80 is too great, or when other circumstances demand it. FIG. 11 shows straps 92*a*, 92*b* attached perpendicularly to the joists 80. However, the straps 92*a*, 92*b* may be attached to the joists 80 at various angles. The straps 92*a*, 92*b* may be positioned substantially parallel to each other separated by a set distance (although depending on the configuration this may not be necessary). The first pair of straps 92*a* in FIG. 11 may be separated from each other by a spacing of around 16 inches, while the second pair of straps 92*b* may be separated from each other by a spacing of around 24 inches. Since 16 inches and 24 inches are common distances in house building, there may be advantages to separating the straps 92*a*, 92*b* by one of these spacings. However, other distances may be used without a decrease in the track's 100 performance.

Once the straps 92*a*, 92*b* are attached to the joists 80, the tracks 100 may be attached to the straps 92*a*, 92*b*. FIG. 11 shows tracks 100 attached perpendicularly to the straps 92*a*, 92*b*. However, the tracks 100 may be attached to the joists 80 at many different angles. The tracks 100 may be positioned substantially parallel to each other such that a container 82 with a fixed width would be able to slide between two tracks 100. Part of the container 82 may be supported by part of the track 100. In one embodiment, the rail 104 of the track 100 supports a flange on the container 82.

In another embodiment (not shown), a first and second track 100 are connected before they are attached to a structural member such as a joist 80 or other portion of a ceiling. In this embodiment, the distance between the pair of tracks may be set so that the size of container 82 used would not be variable. This embodiment may have certain advantages, such as when the structural support cannot accommodate a first and second track 100 being installed separately. Instead, a first and second track 100 could be installed or attached as a unit.

The above description is merely illustrative. Having thus described several aspects of at least one embodiment of this invention including the preferred embodiments, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A hanger track assembly for storage containers, wherein the storage containers include walls that define an interior space accessed by an opening and a flange having a height and a bottom surface, wherein the flange is formed about the opening such that the outer dimensions of the walls are less than the outer dimensions of the flange, the assembly comprising a first and a second pre-formed hanger track that are each integrally formed, wherein the first and second pre-formed hanger tracks each include a planar surface that extends in a lengthwise direction that is contoured to be mounted to and to extend substantially parallel to a ceiling in the lengthwise direction, a vertical support that extends outward from the planar surface a distance that is greater than or equal to the height of the flange and at least one retention surface that extend laterally outward from the vertical support a distance selected so that the bottom surface of the flange is retained on the retention surface when the first and second hanger tracks are mounted so as to be substantially horizontal wherein a securing surface is formed adjacent to the retention surfaces and wherein the securing surface, the vertical support, and the planar surface are dimensioned so as to receive fasteners therethrough so that the first and second pre-formed hanger tracks can be mounted to a ceiling by attaching fasteners through the securing surface, the vertical support and the planar surface into the ceiling and wherein the vertical support wherein the vertical support has a thickness of less than ½ an inch and has inner walls that defines an inner hollow space that receives the fastener and is sized so that the inner walls of the inner hollow space are adjacent the outer surface of the fastener.

2. The hanger track assembly of claim 1, wherein the first and second pre-formed hanger tracks are formed of extruded plastic.

3. The hanger track assembly of claim 1, wherein the vertical support comprises two wall members that define an opening.

4. The hanger track assembly of claim 3, wherein the opening of the vertical support is sized so as to receive a member extending horizontally from a wall so as to retain the first or second vertical support in an orientation that is substantially horizontal.

5. The hanger track assembly of claim 1, wherein the vertical support has a width that is selected so that a standard size container can be mounted between the first and second pre-formed hanger tracks when the first and second pre-formed hanger tracks are secured to joists in the ceiling that are positioned approximately 16 inches apart on center.

6. The hanger track assembly of claim 5, wherein the width of the vertical support is less than 0.5 inches.

7. The hanger track assembly of claim 1, wherein the first and second pre-formed hanger tracks are between 25 and 27 inches long, and the vertical supports extend outward from the planar surface between 1.5 and 2.5 inches.

8. The hanger track assembly of claim 1, wherein the first pre-formed hanger track is attached to a first joist and the second pre-formed hanger track is attached to a second joist and wherein the first pre-formed hanger track is positioned substantially parallel to the second pre-formed hanger track.

9. The hanger track assembly of claim 1, wherein the first pre-formed hanger track is attached to a first joist and a second joist, and the second pre-formed hanger track is attached the first joist and the second joist, and wherein the first pre-formed hanger track is positioned substantially parallel to the second pre-formed hanger track.

10. The hanger track assembly of claim 9, wherein the first and second joists are approximately 24 inches apart on center.

11. The hanger track assembly of claim 1, wherein a first board is attached to a first joist and a second joist, and a second board is attached to the first joist and the second joist, and wherein the first pre-formed hanger track is attached to the first board and the second board, and wherein the second pre-formed hanger track is attached to the first board and the second board.

12. The hanger track assembly of claim 11, wherein the first and second boards are attached to the first and second joists at substantially right angles, and where the first and second pre-formed hanger tracks are attached to the first and second boards at substantially right angles.

13. The hanger track assembly of claim 1, further comprising a first and second vertical mounting surface and a first and second mounting bracket, wherein the first mounting bracket is attached to the first vertical mounting surface and the second mounting bracket is attached to the second vertical mounting surface, and wherein the first pre-formed hanger track is engaged with the first mounting bracket and the second pre-formed hanging track is engaged with the second mounting bracket, and wherein the first pre-formed hanger track is positioned substantially parallel to the second pre-formed hanger track.

14. The hanger track assembly of claim 1, further comprising a rail having a cross-sectional shape, wherein the cross-sectional shape is a trapezoid comprising the at least one retention surface, wherein the retention surface is positioned to retain at least a portion of the flange.

15. The hanger track assembly of claim 1, wherein the planar surface extends laterally outward only to one side of the vertical support.

* * * * *